US011369979B2

(12) United States Patent
Mercer et al.

(10) Patent No.: US 11,369,979 B2
(45) Date of Patent: Jun. 28, 2022

(54) HIGH IMPACT SPRAY NOZZLE

(71) Applicant: CHURCH & DWIGHT CO., INC., Princeton, NJ (US)

(72) Inventors: Micheal Mercer, Bryan, TX (US); Jackson McReynolds, Bryan, TX (US)

(73) Assignee: CHURCH & DWIGHT CO., INC., Princeton, NJ (US)

( * ) Notice: Subject to any disclaimer, the term of this patent is extended or adjusted under 35 U.S.C. 154(b) by 0 days.

(21) Appl. No.: 16/637,715

(22) PCT Filed: Aug. 10, 2018

(86) PCT No.: PCT/US2018/046357

§ 371 (c)(1),
(2) Date: Feb. 7, 2020

(87) PCT Pub. No.: WO2019/033063

PCT Pub. Date: Feb. 14, 2019

(65) Prior Publication Data

US 2021/0146384 A1 May 20, 2021

Related U.S. Application Data

(60) Provisional application No. 62/543,858, filed on Aug. 10, 2017.

(51) Int. Cl.
*B05B 3/04* (2006.01)
*B05B 12/00* (2018.01)
(Continued)

(52) U.S. Cl.
CPC ..... *B05B 3/0463* (2013.01); *B05B 12/008* (2013.01); *B08B 3/02* (2013.01); *B08B 13/00* (2013.01)

(58) Field of Classification Search
CPC ..... B05B 3/0463; B05B 12/008; B08B 3/02; B08B 13/00
See application file for complete search history.

(56) References Cited

U.S. PATENT DOCUMENTS 5,395,053 A 3/1995 Frech
5,524,656 A * 6/1996 Konarski ..... B08B 1/00 15/345

(Continued)

OTHER PUBLICATIONS

International Application No. PCT/US18/46357, "Notification of Transmittal of the International Search Report and the Written Opinion of the International Searching Authority", dated Nov. 15, 2018, pp. 1-10.

*Primary Examiner* — Alexander Markoff
(74) *Attorney, Agent, or Firm* — Kunzler Bean & Adamson, PC

(57) ABSTRACT

Apparatuses, systems, and methods are disclosed for a spray nozzle 100, 200, 600. A spray nozzle 100, 200, 600 includes a housing 102 with an inlet 104 and/or a nose cone 106. An axis of an inlet 104 is disposed perpendicular to an axis of a nose cone 106, the housing 102 comprising an internal chamber formed within the housing 102. A spray nozzle 100, 200, 600 includes a nozzle holder 204. A nozzle holder 204 is disposed within an internal chamber of a body. A nozzle holder 204 is secured at a nozzle seat 202 coupled to a nose cone 106. A distal end of a nozzle holder 204 is free to rotate within an internal chamber of a housing 102 along a conical path having a vertex at approximately a nozzle seat 202 of a body. A nozzle holder 204 comprises an internal fluid channel to direct a fluid stream from a distal end of the nozzle holder 204 to a nozzle seat 202.

19 Claims, 5 Drawing Sheets

(51) Int. Cl.
*B08B 3/02* (2006.01)
*B08B 13/00* (2006.01)

(56) References Cited

U.S. PATENT DOCUMENTS

| | | | | |
|---|---|---|---|---|
| 7,273,188 | B2 | 9/2007 | Saha | |
| 8,820,659 | B2 | 9/2014 | Wesch et al. | |
| 2003/0209611 | A1* | 11/2003 | Harris | B05B 3/0463 239/251 |
| 2005/0067000 | A1* | 3/2005 | Kosugi | B08B 3/02 134/18 |
| 2014/0084075 | A1* | 3/2014 | Vandelli | B05B 12/008 239/1 |
| 2014/0299165 | A1* | 10/2014 | Barnes | B05B 7/0483 134/36 |
| 2015/0090303 | A1* | 4/2015 | Lomas | B08B 3/02 134/33 |
| 2015/0217305 | A1* | 8/2015 | Yie | B08B 3/02 239/240 |
| 2016/0000004 | A1* | 1/2016 | Ni | B05B 12/085 239/74 |
| 2016/0008859 | A1* | 1/2016 | Høxbroe | B05B 15/14 134/113 |
| 2016/0175869 | A1* | 6/2016 | Sullivan | A01M 7/0089 239/11 |
| 2017/0348718 | A1* | 12/2017 | Preheim | A01M 7/0089 |

* cited by examiner

HIGH IMPACT SPRAY NOZZLE

FIELD

This invention relates to a fluid nozzle and more particularly relates to a high impact spray nozzle.

BACKGROUND

Spray nozzles may be used in various industrial, agricultural, and commercial settings. Spray nozzles that clean a surface area of a target project a fan-shaped fluid pattern in order to provide sufficient cleaning coverage to the target. However, fan nozzles deliver a relatively small amount of impact energy to the cleaning surface due to the atomization of the fluid to form the fan. Forming the fan-shaped pattern results in relatively smaller droplets of water which carry less energy to the surface than a single stream. To compensate for this loss of energy, higher volumes and pressures are used.

SUMMARY

Apparatuses, systems, and methods are disclosed for a spray nozzle. In one embodiment, a spray nozzle includes a housing with an inlet and/or a nose cone. An axis of an inlet, in certain embodiments, is disposed perpendicular to an axis of a nose cone, the housing comprising an internal chamber formed within a housing. A spray nozzle, in a further embodiment, includes a nozzle holder. A nozzle holder, in one embodiment, is disposed within an internal chamber of a body. A nozzle holder, in certain embodiments, is secured at a nozzle seat coupled to a nose cone. An end of a nozzle holder, in one embodiment, is distal from a nozzle seat. A distal end of a nozzle holder, in some embodiments, is free to rotate within an internal chamber of a housing along a conical path having a vertex at approximately a nozzle seat of a body. In one embodiment, a nozzle holder comprises an internal fluid channel to direct a fluid stream from a distal end of the nozzle holder to a nozzle seat.

A system, in one embodiment, includes a spray washing cabinet. In a further embodiment, a system includes a spray nozzle coupled to a spray washing cabinet. A spray nozzle, in certain embodiments, includes a housing with an inlet and/or a nose cone. An axis of an inlet, in some embodiments, is disposed perpendicular to an axis of a nose cone, the housing comprising an internal chamber formed within a housing. A spray nozzle, in a further embodiment, includes a nozzle holder. A nozzle holder, in one embodiment, is disposed within an internal chamber of a body. A nozzle holder, in certain embodiments, is secured at a nozzle seat coupled to a nose cone. An end of a nozzle holder, in one embodiment, is distal from a nozzle seat. A distal end of a nozzle holder, in some embodiments, is free to rotate within an internal chamber of a housing along a conical path having a vertex at approximately a nozzle seat of a body. In one embodiment, a nozzle holder comprises an internal fluid channel to direct a fluid stream from a distal end of the nozzle holder to a nozzle seat.

A method, in one embodiment, includes directing a fluid stream into a nozzle housing of a spray nozzle at a point to rotate the fluid stream within an internal chamber of the nozzle housing. A method, in a further embodiment, includes rotating a nozzle holder along a conical path within an internal chamber of a nozzle housing. A method, in certain embodiments, includes directing a fluid stream into a nozzle holder as the nozzle holder rotates. In some embodiments, a method includes directing a fluid stream to a spray washing target.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
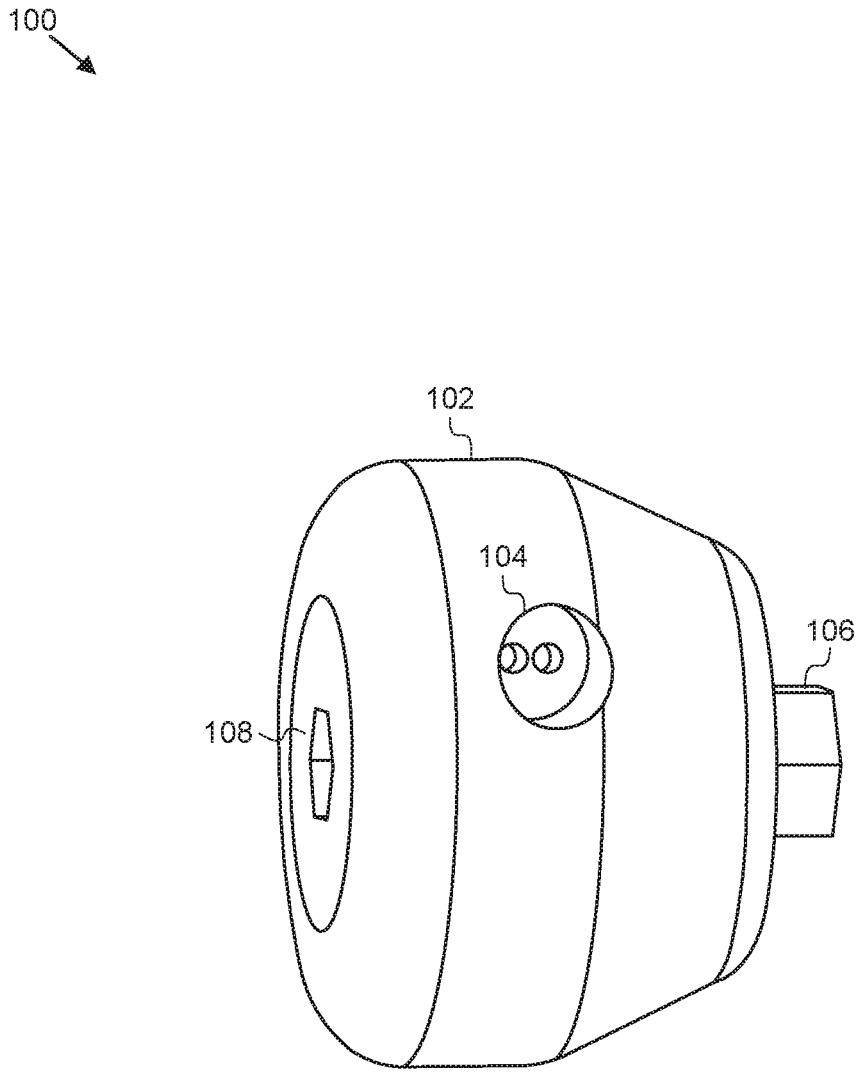
FIG. 1 is a perspective view illustrating one embodiment of a high impact nozzle.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

These features and advantages of the embodiments will become more fully apparent from the following description and appended claims, or may be learned by the practice of embodiments as set forth hereinafter. As will be appreciated by one skilled in the art, aspects of the present invention may be embodied as a system, method, and/or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, aspects of the present invention may take the form of a computer program product embodied in one or more computer readable medium(s) having program code embodied thereon.

Many of the functional units described in this specification have been labeled as modules (or components), in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of program code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of program code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Where a module or portions of a module are implemented in software, the program code may be stored and/or propagated on in one or more computer readable medium(s).

The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory ("RAM"), a read-only memory ("ROM"), an erasable programmable read-only memory ("EPROM" or Flash memory), a static random access memory ("SRAM"), a portable compact disc read-only memory ("CD-ROM"), a digital versatile disk ("DVD"), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a wireless network (e.g., a local wireless network, a Wi-Fi® network, a Bluetooth® network, a near-field communication (NFC) network, an ad hoc network, a wireless cellular network), a local area network (LAN), a wide area network (WAN), a storage area network (SAN), an optical fiber network, through the Internet using an Internet Service Provider, and/or other digital communication network. In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts.

FIG. 1 is a perspective view illustrating one embodiment of a high impact nozzle 100. The illustrated embodiment of the nozzle 100 includes a housing 102, an inlet 104, a nose cone 106, and an end cap 108. In some embodiments, the housing 102 secures the inlet 104, the nose cone 106, and the end cap 108.

In some embodiments, a water or other fluid source is coupled to the inlet 104 to supply fluid to the nozzle 100. The inlet 104 may include securing features such as threads, a friction lock, clamp, or other feature to secure a fluid source to the nozzle 100. The inlet 104 supplies fluid to an internal chamber of the nozzle 100.

In some embodiments, the nose cone 106 is in fluid communication with the internal chamber of the nozzle 100. In some embodiments, the nose cone 106 releases the fluid from the internal chamber to form a conical spray pattern. In some embodiments, the conical spray pattern is formed by a rotational movement of a component of the nose cone 106. In some embodiments, the nose cone 106 forms a 22° conical spray pattern. Other embodiments incorporate angles that are lesser or greater than 22°. In some embodiments, the nozzle 100 in a wash cabinet provides coverage over approximately 14 sq. in. whereas a traditional fan-spray nozzle at a similar 22° provides coverage over 2.14 sq. in. In this way, the coverage area of the nozzle 100 is increased over conventional nozzles.

In some embodiments, the nose cone 106 of the nozzle 100 forms a rotational stream. In some embodiments, the formation of a stream reduces the energy loss from forming a fan in a traditional nozzle. In some embodiments, the rotational stream provides superior surface impact at a cleaning target to remove contaminant. For example, in a protein washing application, the nozzle 100 may provide sufficient impact energy to remove bone dust, smudge, blood clots, and the like.

In some embodiments, the nozzle 100 provides a sufficient surface impact energy with reduced pressure and volume relative to conventional nozzles. In one embodiment, the inlet 104 comprises a rotational jet, which may be sized to adjust (e.g., increase and/or decrease) a rate of rotation (e.g., rotations per minute (RPM)) for the nozzle 100. For example, adjusting an orifice size for the inlet 104 may adjust the rate of rotation for the nozzle 100. In some embodiments, the inlet 104 may be replaceable and/or interchangeable with multiple inlets 104 of different orifice sizes (e.g., the nozzle 100 may be disconnected from the fluid supply, and a different inlet 104 inserted with a different orifice size to adjust the rate of rotation, or the like). In some embodiments, the nose cone 106 and the end cap 108 can both be accessed without disturbing the supply connection via the inlet 104.

In some embodiments, the nozzle 100 operates between approximately 5-10,000 psi. In other embodiments, the nozzle 100 operates between approximately 30-500 psi. In some embodiments, the nozzle 100 operates between approximately 500-10,000 psi. Other thresholds are contemplated.

In the illustrated embodiment, the end cap 108 is disposed on the nozzle 100 opposite the nose cone 106. In some embodiments, the end cap 108 provides a seal with the housing 102 to prevent leaking of fluid from the nozzle 100. In the illustrated embodiment, the end cap 108 includes a tool recess to facilitate use of a tool to adjust an angle of spray from the nozzle 100 (e.g., adjusting the angle of spray between about 0 and 180 degrees, between about 0 and 90 degrees, between about 0 and 50 degrees, between about 5 and 45 degrees, between about 10 and 40 degrees, or the like). The end cap 108 is discussed in greater detail below with reference to FIGS. 2 and 3.

Figure 2:
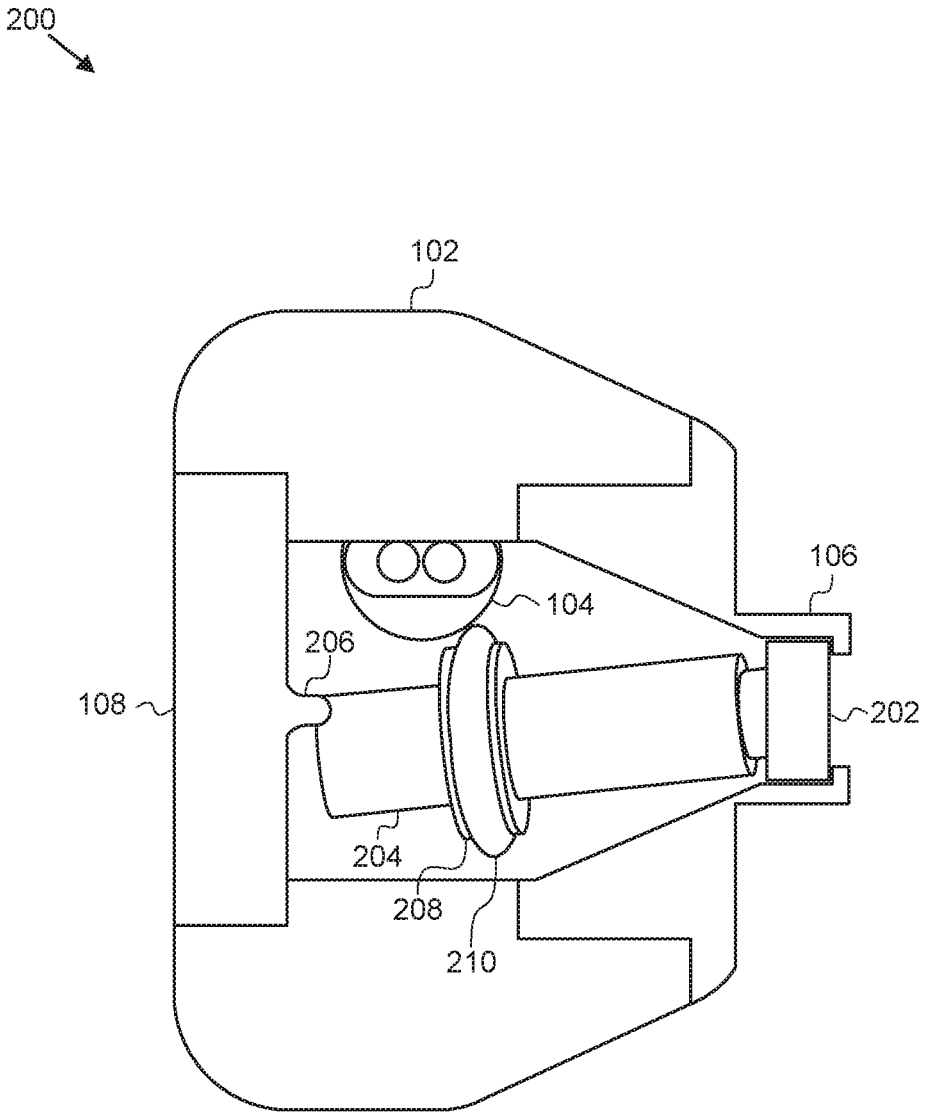
FIG. 2 is a schematic diagram illustrating another embodiment of a high impact nozzle.

FIG. 2 is a schematic diagram illustrating another embodiment of a high impact nozzle 200. The illustrated embodiment includes the housing 102, inlet 104, nose cone 106, and end cap 108 as described above with respect to housing 102. Additionally, the illustrated embodiment includes a nozzle seat 202, a nozzle holder 204, an end cap guide 206, an o-ring seat 208, and an o-ring 210.

In some embodiments, the nozzle seat 202 couples to the nose cone 106. In some embodiments, the nozzle seat 202 forms a socket joint to receive the nozzle holder 204 within the nose cone 106. In some embodiments, the nozzle seat 202 allows for rotational motion of the nozzle holder 204 around an anchor point of the nozzle holder 204 within the nozzle seat 202. In other words, the nozzle seat 202 forms a tip of a cone shape formed by rotation of the nozzle holder 204 within the housing 102.

In some embodiments, the nozzle holder 204 is a hollow tube pivotably coupled to the nozzle seat 202. In some embodiments, the nozzle holder 204 receives a fluid at a first end distal from the nozzle seat 202 and discharges the fluid from a second end proximal the nozzle seat 202. In some embodiments, force applied by fluid entering the housing 102 at the inlet 104 motivates the nozzle holder 204 in a rotational movement pattern around the end cap guide 206.

In the illustrated embodiment, the first end of the nozzle holder 204 rotates about the end cap guide 206. In some embodiments, the end cap guide 206 applies a force to the nozzle holder 204 to maintain and/or adjust a path of travel of the nozzle holder 204 (e.g., adjusting the end cap 108 may actuate the end cap guide 206 to change an angle of spray of the nozzle holder 204). In some embodiments, the geometry of the end cap guide 206 and/or the position of the end cap guide 206 shapes the path of movement of the nozzle holder 204. In some embodiments, the end cap guide 206 is an integrated feature of the end cap 108. In other embodiments, the end cap guide 206 is a separate structure coupled to the end cap 108.

In the illustrate embodiment, the nozzle holder 204 also includes an o-ring seat 208. In the illustrated embodiment, the o-ring seat is a raised feature of the nozzle holder 204 with a geometry sufficient to accept and retain the o-ring 210. In some embodiments, the o-ring seat 208 is a unified portion of the nozzle holder 204. In other embodiments, the o-ring seat 208 is a separate structure coupled to the nozzle holder 204. In some embodiments, the position of the o-ring seat 208 on the nozzle holder 204 is fixed. In other embodiments, the position of the o-ring seat 208 on the nozzle holder 204 is adjustable. While the illustrated embodiment shows the o-ring seat 208 positioned on the nozzle holder 204, the o-ring seat 208 may also be positioned on an inside surface of the housing 102. In another embodiment, the o-ring seat 208 is positioned on an end of the nose cone 106 internal to the housing 102.

In some embodiments, the o-ring 210 is positioned on the o-ring seat 208. In some embodiments, the o-ring 210 includes a rubber, plastic, composite, fabric, metal, ceramic, or other natural or synthetic material. In some embodiments, the o-ring 210 provides a wear surface during rotational movement of the nozzle holder 204. In some embodiments, the o-ring 210 is removably coupled to the o-ring seat 210. In some embodiments, the o-ring 210 mechanically supports the nozzle holder 204. In some embodiments, the o-ring 210 reduces friction caused by movement of the nozzle holder 204.

Figure 3:
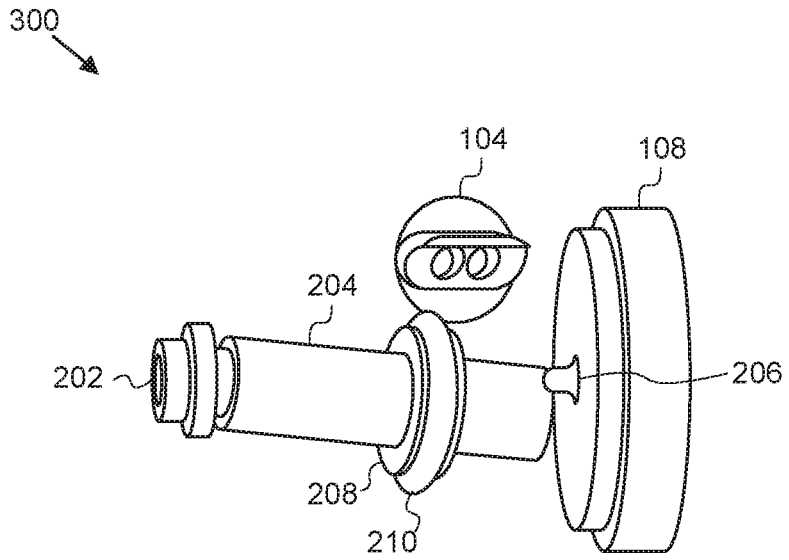
FIG. 3 illustrates a perspective view of one embodiment of a high impact nozzle with the housing removed.

FIG. 3 illustrates a perspective view of one embodiment of a high impact nozzle 300 with the housing 102 removed. In the illustrated embodiment, the angular relation between the nozzle seat 202 and the nozzle holder 204. In some embodiments, the nozzle seat 202 provides the sole retaining force on the nozzle holder 204. In other embodiments, the end cap 108 may apply a force on the nozzle holder 204 in the direction of the nozzle seat 202.

Figure 4:
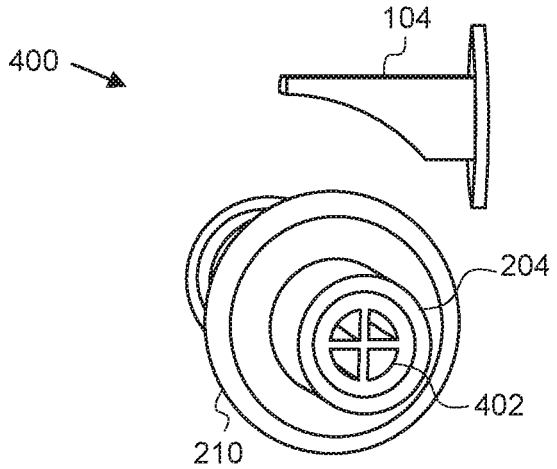
FIG. 4 is a perspective view illustrating one embodiment of a high impact nozzle with the housing and end cap removed.

FIG. 4 is a perspective view illustrating one embodiment of a high impact nozzle 400 with the housing 102 and end cap 108 removed. The illustrated embodiment includes an insert 402 coupled to an interior of the nozzle holder 204. In the illustrated embodiment, the insert 402 forms fluid channels within an interior of the nozzle holder 204 to direct the fluid along the interior of the nozzle holder 204. In some embodiments, the insert 402 applies a quality to the fluid stream passing through the insert 402. For example, the insert 402 may collimate the fluid stream to preserve impact energy and reduce separation and atomization of the fluid stream. In the illustrated embodiment, the insert 402 includes 4 circular sectors. In other embodiments, the insert 402 includes fewer or more circular sectors. In some embodiments, the insert 402 includes other geometries.

In some embodiments, the insert 402 is removable from the nozzle holder 204. For example, depending on the fluid supply pressure, volume, fluid type, or the like, the insert 402 may be swapped to provide greater efficiency or a desired effect. In another example, the insert 402 may be selected based on a desired surface impact energy for a particular target or cleaning application. In some embodiments, the insert 402 includes a twist, surface roughness, progressive geometry change, or other structural or physical aspect to affect or modify the fluid stream.

Figure 5:
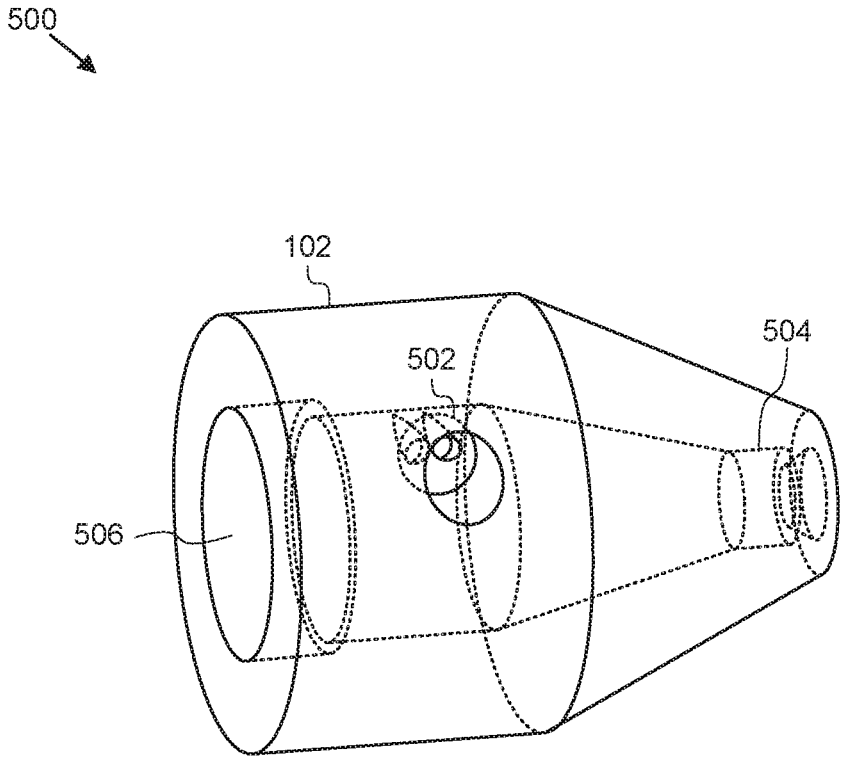
FIG. 5 is a perspective view illustrating a wireframe diagram of one embodiment of a high impact nozzle.

FIG. 5 is a perspective view illustrating a wireframe diagram of one embodiment of a high impact nozzle 500. The illustrated embodiment includes the housing 102 which includes an inlet socket 502, a nozzle seat socket 504, and an end cap socket 506. In some embodiments, the housing 102 is a single unified piece. In other embodiments, the housing 102 is a modular assembly with two or more portions. In some embodiments, the modular portions of the housing 102 are removably coupleable to one another.

In some embodiments, at least one of the inlet socket 502, the nozzle seat socket 504, and the end cap socket 506 includes one or more of a threaded, press-fit, friction-fit, snap lock, magnetic, or similar retention structures to secure a corresponding component. In some embodiments, at least one of the inlet socket 502, the nozzle seat socket 504, and the end cap socket 506 includes a gasket, o-ring, or similar seal or seating component to reducing the chance of a leak or unintended separation of the corresponding component.

The illustrated embodiment of the housing 102 of the nozzle 500 include a generally cylindrical geometry with a tapered nose. In other embodiments, the housing 102 includes a non-cylindrical geometry. In some embodiments, the housing 102 has a geometry corresponding to a mounting arrangement within a washing cabinet or other washing system. In some embodiments, the housing 102 further includes mounting structures coupled to or integrated into the housing 102. The housing 102 may also include additional functional elements such as a drain, flush port, pressure reducer, adjustment interface, or the like.

Figure 6:
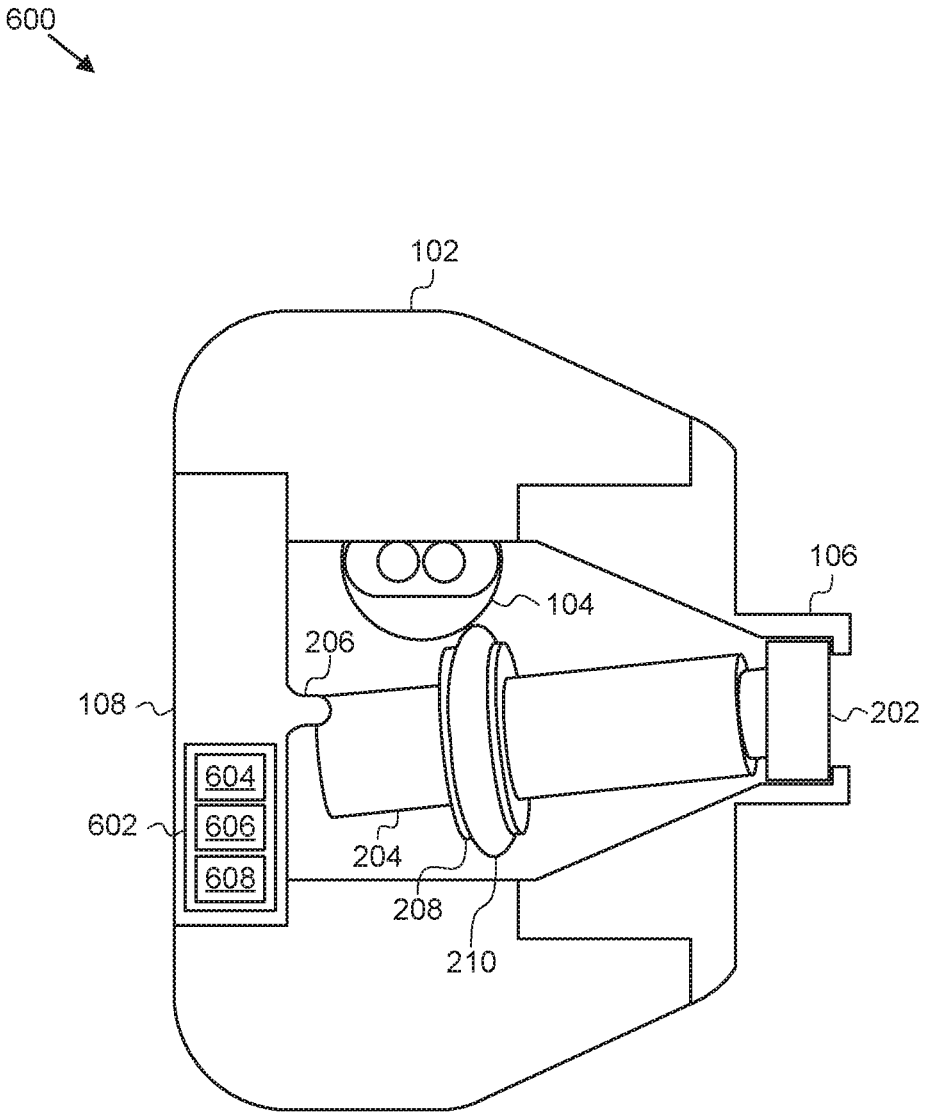
FIG. 6 is a schematic diagram illustrating one embodiment of a high impact nozzle with a monitor module.

FIG. 6 is a schematic diagram illustrating one embodiment of a high impact nozzle 600 with a monitor module 602. In general, in various embodiments, the monitor module 602 monitors a state of the high impact nozzle 600; flow to, in, and/or from the high impact nozzle 600; or the like and communicates information regarding the monitored state to a base station or other control module. The monitor module 602 may comprise logic hardware such as a processor, a central processing unit (CPU), a processor core, a field programmable gate array (FPGA) or other programmable logic, an application specific integrated circuit (ASIC), a controller, a microcontroller, and/or another semiconductor integrated circuit device, firmware, a volatile memory, a non-volatile storage medium, and/or other logic hardware. In a further embodiment, the monitor module 602 may comprise computer executable program code stored on a computer readable storage medium. In some embodiments, the monitor module 602 may include software, hardware, or a combination of both software and hardware. The monitor module 602 may include one or more sensors 604, a communications module 606, and/or a power source 608.

In the depicted embodiment, the monitor module 602 is disposed in an end cap 108, such that the monitor module 602 is removable and/or replaceable without replacing the entire high impact nozzle 600. In other embodiments, the monitor module 602 may be disposed in the housing 102 and/or another location within the nozzle 102.

The one or more sensors 604, in certain embodiments, are configured to detect a state of the high impact nozzle 600 and/or spray of the high impact nozzle 600. For example, the one or more sensors 604 may include one or more of a camera or other optical sensor, a motion sensor, a flow sensor, an accelerometer, a gyroscope, and/or another type of sensor. The one or more sensors 604 may detect and/or monitor a rotation rate of the nozzle holder 204 (e.g., rotations per minute, or the like), a flow rate through the inlet 104, a flow rate into the nozzle holder 204, a flow rate out of the nozzle seat 202 and/or nose cone 106, and/or other state information for the high impact nozzle 600.

The communications module 606, in one embodiment, is configured to communicate with a base station or other control module for one or more high impact nozzles 600. The communications module 606 may send state information detected and/or monitored by the one or more sensors 604 (e.g., a rotation rate, a flow rate, or the like) to the base station or other control module. The communications module 606 may comprise a transmitter, a receiver, a transceiver, or the like for communicating data. For example, the communications module 606 may comprise a network interface card (NIC), a wired network interface, a wireless network interface, or the like.

In certain embodiments, the communications module 606 may communicate with the base station or other control module using a direct and/or peer-to-peer connection (e.g., a direct wireless connection, over a universal serial bus (USB) or another serial interface, or the like). In some embodiments, the communications module 606 may communicate with the base station or other control module over a data network (e.g., a digital communication network that transmits digital communications, or the like).

A data network may include a wireless network, such as a local wireless network, such as a Wi-Fi® network, a Bluetooth® network, a near-field communication (NFC) network, an ad hoc network, a wireless cellular network, and/or the like. A data network may include a wide area network (WAN), a storage area network (SAN), a local area network (LAN), an optical fiber network, the interne, or other digital communication network. A data network may include two or more networks. A data network may include one or more servers, routers, switches, and/or other networking equipment.

The power source 608, in one embodiment, may provide electric power to the communications module 606 and/or the one or more sensors 604. For example, in various embodiments, the power source 608 may comprise one or more batteries, one or more capacitors or super capacitors, a power supply in electrical communication with a wall outlet or other connection to an electrical utility, or the like. In embodiments where the monitor module 602 or a portion thereof is removable from the high impact nozzle 600 and/or is replaceable, or the like, the power source 608 may comprise one or more batteries that may be removable and/or replaceable.

The base station and/or other control module that receives state information from the communications module 606 (e.g., detected and/or monitored by the one or more sensors 604, or the like), may use the state information to determine coverage of a spray pattern from the high impact nozzle 600, an effectiveness of spray from the high impact nozzle 600, an error in the high impact nozzle 600 (e.g., blockage, a broken component, an incorrect configuration, or the like). In response to a trigger (e.g., a predefined error condition, a rotation rate above or below a predefined threshold, a flow rate above or below a predefined threshold, or the like), the base station and/or other control module may send an alert or other message to an administrator or other user (e.g., an electronic message such as a text message, an email, an audible alarm from a speaker, a push notification, an entry in a log, or the like), which may be able to troubleshoot and/or remedy the error condition (e.g., by reconfiguring and/or replacing the high impact nozzle 600, or the like).

In one embodiment, the monitor module 602 may comprise one or more electrically actuated mechanical actuators, configured to adjust one or more settings of the high impact spray nozzle 600 in response to a command sent to the communications module 606 from the base station and/or other control module. In such an embodiment, the base station and/or other control module may adjust an orientation of the high impact spray nozzle 606 relative to a spray target, may adjust a rotational speed of the nozzle holder 204, may adjust a cone angle of the fluid stream directed to the spray target, may adjust a volume of the fluid stream directed to the spray target, or the like.

In certain embodiments, an array of high impact nozzles 600 comprise monitor modules 602 that report to the same base station and/or other control module, and that work together to spray the same object (e.g., the same cleaning target, or the like), and the base station and/or other control module may process state information from multiple high impact nozzles 600 of the array to determine a sufficiency of a combined coverage pattern for the sprayed object. For example, the base station and/or other control module may allow a threshold number of high impact nozzles 600 to fail and/or have an error condition before alerting and/or notifying a user, if the other high impact nozzles 600 are functioning correctly, may allow a spray process to continue of no adjacent high impact nozzles 600 have error conditions, or the like.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A spray nozzle comprising:

a housing comprising an inlet and a nose cone, wherein an axis of the inlet is disposed perpendicular to an axis of the nose cone, the housing comprises an internal chamber formed within the housing, and the inlet comprises a rotational jet with multiple orifices;

a nozzle holder disposed within the internal chamber of the housing, the nozzle holder secured at a nozzle seat coupled to the nose cone, an end of the nozzle holder distal from the nozzle seat, the distal end of the nozzle holder being free to rotate within the internal chamber of the housing along a conical path, the conical path having a vertex at approximately the nozzle seat of the body, the nozzle holder comprising an internal fluid channel to direct a fluid stream from the distal end of the nozzle holder to the nozzle seat;

an insert coupled to an interior of the nozzle holder, the insert having an internal geometry with multiple sectors forming multiple fluid channels within the interior of the nozzle holder to collimate the fluid stream as it passes through the nozzle holder; and an end cap disposed in the housing opposite the nose cone, the end cap comprising a post disposed centrally on the end cap and external to the nozzle holder such that an exterior of the nozzle holder orbits around an exterior of the post within the internal chamber.

2. The spray nozzle of claim 1, wherein the inlet is disposed on a side of the housing at a location to direct the fluid stream into the internal chamber and motivate the rotation of the nozzle holder.

3. The spray nozzle of claim 2, wherein the inlet comprises a rotational jet aligned to direct the fluid stream into the internal chamber off-center to apply a force to the nozzle holder.

4. The spray nozzle of claim 1, wherein the spray nozzle is adjustable to change a cone angle of the fluid stream as it exits the spray nozzle.

5. The spray nozzle of claim 1, wherein the spray nozzle is adjustable to change a volume of the fluid stream.

6. The spray nozzle of claim 1, wherein the spray nozzle is adjustable to change a rotational speed of the nozzle holder.

7. The spray nozzle of claim 1, wherein the nozzle holder comprises an o-ring coupled to the nozzle holder between the nozzle seat and the distal end, the o-ring forming a friction barrier between a surface of the internal chamber and the nozzle holder during rotation of the nozzle holder.

8. The spray nozzle of claim 1, wherein the housing further comprises an o-ring disposed on a surface of the internal chamber and forming a friction barrier between the surface of the internal chamber and the nozzle holder during rotation of the nozzle holder.

9. The spray nozzle of claim 1, wherein the post comprises a guide to interface with the distal end of the nozzle holder.

10. The spray nozzle of claim 9, wherein the post disposed centrally on the end cap protrudes into the internal chamber.

11. The spray nozzle of claim 9, wherein the end cap is adjustable to change the interface between the guide and the nozzle holder.

12. The spray nozzle of claim 9, wherein the end cap is removable from the housing.

13. The spray nozzle of claim 1, further comprising:

one or more sensors configured to detect one or more of a rotation rate of the nozzle holder and a flow rate of the fluid stream; and a communications module configured to transmit the one or more of the rotation rate and the flow rate to a base station for the spray nozzle.

14. A system for spray washing, the system comprising:

a spray washing cabinet;

a spray nozzle coupled to the spray washing cabinet, the spray nozzle comprising:

a housing comprising an inlet and a nose cone, wherein an axis of the inlet is disposed perpendicular to an axis of the nose cone, the housing comprises an internal chamber formed within the housing, and the inlet comprises a rotational jet with multiple orifices;

a nozzle holder disposed within the internal chamber of the housing, the nozzle holder secured at a nozzle seat coupled to the nose cone, an end of the nozzle holder distal from the nozzle seat, the distal end of the nozzle holder being free to rotate within the internal chamber of the housing along a conical path, the conical path having a vertex at approximately the nozzle seat of the body, the nozzle holder comprising an internal fluid channel to direct a fluid stream from the free end of the nozzle holder to the nozzle seat;

an insert coupled to an interior of the nozzle holder, the insert having an internal geometry with multiple sectors forming multiple fluid channels within the interior of the nozzle holder to collimate the fluid stream as it passes through the nozzle holder; and an end cap disposed in the housing opposite the nose cone, the end cap comprising a post disposed centrally on the end cap and external to the nozzle holder such that an exterior of the nozzle holder orbits around an exterior of the post within the internal chamber.

15. The system of claim 14, wherein the spray washing cabinet comprises a plurality of spray nozzles.

16. The system of claim 15, further comprising a control module for the plurality of spray nozzles, wherein the plurality of spray nozzles each comprise a communications module in wireless communication with the control module and one or more sensors, the communications modules transmitting data from the one or more sensors wirelessly to the control module.

17. A method for spray washing, the method comprising:

directing a fluid stream into a nozzle housing of a spray nozzle at an inlet at a point to rotate the fluid stream within an internal chamber of the nozzle housing, the inlet comprising a rotational jet with multiple orifices;

rotating a nozzle holder along a conical path within the internal chamber of the nozzle housing such that an exterior of the nozzle holder orbits around an exterior of a post within the internal chamber, the post disposed centrally on an end cap and external to the nozzle holder, the end cap disposed in the nozzle housing opposite the nose cone;

directing the fluid stream into the nozzle holder as the nozzle holder rotates;

directing the fluid stream through an insert coupled to an interior of the nozzle holder, the insert having an internal geometry with multiple sectors forming multiple fluid channels within the interior of the nozzle holder to collimate the fluid stream as it passes through the nozzle holder; and directing the fluid stream to a spray washing target.

18. The method of claim 17, further comprising adjusting the spray nozzle to apply an effect on the fluid stream to correspond to the spray washing target.

19. The method of claim 18, wherein adjusting the spray nozzle comprises at least one of adjusting a rotational speed of the nozzle holder, a cone angle of the fluid stream directed to the spray washing target, and a volume of the fluid stream directed to the spray washing target.

* * * * *